US012259133B2

(12) United States Patent
Joshi

(10) Patent No.: US 12,259,133 B2
(45) Date of Patent: Mar. 25, 2025

(54) COOLING COMBUSTOR WALL BOSS

(71) Applicant: Raytheon Technologies Corporation, Farmington, CT (US)

(72) Inventor: Dibesh D. Joshi, South Windsor, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/110,230

(22) Filed: Feb. 15, 2023

(65) Prior Publication Data

US 2024/0271785 A1 Aug. 15, 2024

(51) Int. Cl.
*F23R 3/00* (2006.01)

(52) U.S. Cl.
CPC .... *F23R 3/002* (2013.01); *F23R 2900/03044* (2013.01)

(58) Field of Classification Search
CPC .... F23R 3/002; F23R 3/04; F23R 3/06; F23R 2900/0304; F23R 2900/03042; F23R 2900/03044
See application file for complete search history.

(56) References Cited

U.S. PATENT DOCUMENTS 4,132,066 A * 1/1979 Austin, Jr. ..... F23R 3/06 60/752
6,145,319 A 11/2000 Burns
10,041,675 B2 8/2018 Lebel
10,088,159 B2 10/2018 Erbas-Sen
10,151,486 B2 12/2018 Sandoval
10,309,314 B2 6/2019 Hoke
10,317,079 B2 6/2019 Kostka, Jr.
10,386,068 B2 8/2019 Kostka, Jr.
10,502,422 B2 12/2019 Cunha
10,571,125 B2 2/2020 Moura
10,612,781 B2 4/2020 Cunha
10,648,666 B2 5/2020 Bouldin
10,684,017 B2 6/2020 Moura
(Continued)

OTHER PUBLICATIONS

EP Search Report for EP Patent Application No. 24157914.3 dated Jul. 9, 2024.

*Primary Examiner* — Arun Goyal
*Assistant Examiner* — Henry Ng
(74) *Attorney, Agent, or Firm* — Getz Balich LLC

(57) ABSTRACT

A combustor wall includes a panel, a boss, a wall aperture and multiple cooling apertures. The panel extends axially along and circumferentially about an axial centerline. The panel extends radially between a first panel surface and a second panel surface. The first panel surface forms a peripheral boundary of a combustion chamber. The boss projects out from the second panel surface. The boss extends circumferentially around and forms an outer peripheral boundary of the wall aperture. The wall aperture extends along a wall aperture centerline through the combustor wall to the first panel surface. The cooling apertures are arranged circumferentially about the wall aperture. Each of the cooling apertures extends along a cooling aperture centerline through the panel and/or the boss to the wall aperture. The cooling aperture centerline of a first of the cooling apertures is angularly offset from the wall aperture centerline by a first acute angle.

20 Claims, 9 Drawing Sheets

(56) References Cited

U.S. PATENT DOCUMENTS

| | | | | |
|---|---|---|---|---|
| 10,753,283 | B2 | 8/2020 | Lao | |
| 10,968,829 | B2 | 4/2021 | Cunha | |
| 11,391,460 | B2 | 7/2022 | Ichihashi | |
| 2009/0064657 | A1* | 3/2009 | Zupanc | F02C 7/264 60/39.821 |
| 2010/0212324 | A1* | 8/2010 | Bronson | F23R 3/06 60/39.821 |
| 2011/0120132 | A1 | 5/2011 | Rudrapatna | |
| 2013/0078582 | A1* | 3/2013 | Pidcock | F23R 3/06 431/12 |
| 2014/0007580 | A1 | 1/2014 | Richardson | |
| 2014/0033723 | A1* | 2/2014 | Doerr | F23R 3/045 60/737 |
| 2014/0083112 | A1* | 3/2014 | Jause | F23R 3/002 60/757 |
| 2015/0354818 | A1* | 12/2015 | Lebel | F02C 7/28 60/796 |
| 2015/0354819 | A1* | 12/2015 | Snyder | F02C 7/18 60/754 |
| 2016/0025342 | A1 | 1/2016 | Erbas-Sen | |
| 2016/0208704 | A1 | 7/2016 | Bouldin | |
| 2016/0237896 | A1* | 8/2016 | Leglaye | F23R 3/04 |
| 2017/0059162 | A1* | 3/2017 | Papple | F23R 3/002 |
| 2019/0195495 | A1* | 6/2019 | Moura | F02C 7/185 |
| 2019/0368736 | A1* | 12/2019 | Rudrapatna | F23R 3/045 |
| 2020/0049349 | A1* | 2/2020 | Amble | F23R 3/007 |

* cited by examiner 82,110A
88
86
166
170
172
164
118A
118B
118A
118A
118A
118B
118A
118B
118A
118B
118A
118B
118A
118A
118A

COOLING COMBUSTOR WALL BOSS

BACKGROUND OF THE DISCLOSURE

1. Technical Field

This disclosure relates generally to a turbine engine and, more particularly, to a combustor wall for the turbine engine.

2. Background Information

A floating wall combustor for a turbine engine typically includes a bulkhead, an inner combustor wall and an outer combustor wall. The bulkhead extends radially between the inner and the outer combustor walls. Each combustor wall includes a shell and a heat shield that defines a respective radial side of a combustion chamber. Cooling cavities extend radially between the heat shield and the shell. These cooling cavities fluidly couple impingement apertures defined in the shell with effusion apertures defined in the heat shield.

Each combustor wall may also include a plurality of igniter aperture bosses located between the shell and the heat shield. Each of the igniter aperture bosses defines an igniter aperture radially through the combustor wall that receives an igniter. The igniter aperture bosses as well as adjacent portions of the heat shield are typically subject to relatively high temperatures during engine operation, which can induce relatively high thermal stresses within the bosses and the heat shield. Various cooling techniques are known in the art for cooling the bosses and the heat shield. While known cooling techniques have various benefits, some of these cooling techniques may require a relatively large pressure drop across the combustor wall to implement. There is a need in the art therefore for boss and heat shield cooling techniques which can reduce pressure drop across a combustor wall.

SUMMARY OF THE DISCLOSURE

According to an aspect of the present disclosure, an apparatus is provided for a turbine engine. This apparatus includes a combustor wall. The combustor wall includes a panel, a boss, a wall aperture and a plurality of cooling apertures. The panel extends axially along and circumferentially about an axial centerline. The panel extends radially between a first panel surface and a second panel surface. The first panel surface forms a peripheral boundary of a combustion chamber. The boss projects out from the second panel surface. The boss extends circumferentially around and forms an outer peripheral boundary of the wall aperture. The wall aperture extends along a wall aperture centerline through the combustor wall to the first panel surface. The cooling apertures are arranged circumferentially about the wall aperture. Each of the cooling apertures extends along a cooling aperture centerline through the panel and/or the boss to the wall aperture. The cooling aperture centerline of a first of the cooling apertures is angularly offset from the wall aperture centerline by a first acute angle.

According to another aspect of the present disclosure, another apparatus is provided for a turbine engine. This apparatus includes a combustor wall. The combustor wall includes a panel, a boss, a wall aperture and a plurality of cooling apertures. The panel extends axially along and circumferentially about an axial centerline. The panel extends radially between a first panel surface and a second panel surface. The first panel surface forms a peripheral boundary of a combustion chamber. The boss projects out from the second panel surface. The boss extends circumferentially around and forms an outer peripheral boundary of the wall aperture. The wall aperture extends longitudinally along a wall aperture centerline through the combustor wall to the first panel surface. The boss cooling apertures are arranged circumferentially about the wall aperture. Each of the boss cooling apertures extends through the panel and/or the boss to an outlet orifice at the wall aperture. The outlet orifice from a first of the cooling apertures and the outlet orifice from a second of the cooling apertures are longitudinally offset along the wall aperture centerline.

According to still another aspect of the present disclosure, another apparatus is provided for a turbine engine. This apparatus includes a combustor wall. The combustor wall includes a heat shield, a shell, a cooling cavity and a wall aperture extending along a wall aperture centerline through the combustor wall. The heat shield is attached to the shell. The heat shield includes a panel, a boss and a plurality of cooling apertures. The boss projects out from the panel, through the cooling cavity, to a distal end of the boss engaged with the shell. The boss extends circumferentially around and forms an outer peripheral boundary of the wall aperture. The cooling apertures are arranged circumferentially about the wall aperture. Each of the cooling apertures extends along a cooling aperture centerline through the panel and/or the boss to the wall aperture. The cooling aperture centerline of a first of the cooling apertures is angularly offset from the wall aperture centerline by a first acute angle.

Each of the boss cooling apertures may extend along a cooling aperture centerline through the panel and/or the boss to the outlet orifice at the wall aperture. The cooling aperture centerline of the first of the cooling apertures may be angularly offset from the wall aperture centerline by a first acute angle.

The wall aperture may form an igniter aperture through the combustor wall.

The first acute angle may be between twenty degrees and forty-five degrees.

The first acute angle may be between forty-five degrees and seventy degrees.

The cooling aperture centerline of the first of the cooling apertures may be straight.

The cooling aperture centerline of a second of the cooling apertures may be angularly offset from the wall aperture centerline by a second acute angle that is different than the first acute angle.

The second of the cooling apertures may circumferentially neighbor the first of the cooling apertures about the wall aperture.

A first inlet orifice into the first of the cooling apertures may be disposed a first radial distance from the second panel surface. A second inlet orifice into the second of the cooling apertures may be disposed a second radial distance from the second panel surface that is equal to the first radial distance.

A first outlet orifice from the first of the cooling apertures may be disposed a first radial distance from the first panel surface. A second outlet orifice from the second of the cooling apertures may be disposed a second radial distance from the first panel surface that is different than the first radial distance.

A first inlet orifice into the first of the cooling apertures and a second inlet orifice into a second of the cooling apertures may be longitudinally aligned along the wall aperture centerline.

A first outlet orifice from the first of the cooling apertures and a second outlet orifice from a second of the cooling apertures may be longitudinally offset along the wall aperture centerline.

A first section of the boss may include a first set of the cooling apertures. The cooling aperture centerline of each cooling aperture in the first set of the cooling apertures may be angularly offset from the wall aperture centerline by the first acute angle. A second section of the boss, circumferentially adjacent the first section, may include a second set of the cooling apertures. The cooling aperture centerline of one cooling aperture in the second set of the cooling apertures may be angularly offset from the wall aperture centerline by the first acute angle. The cooling aperture centerline of another cooling aperture in the second set of the cooling apertures may be angularly offset from the wall aperture centerline by a second acute angle that is different than the first acute angle.

The first section may extend circumferentially about the wall aperture centerline from a first end of the first section to a second end of the first section. The second section may extend circumferentially about the wall aperture centerline from the first end of the first section to the second end of the first section.

The first section may extend between ninety degrees and two-hundred and seventy degrees about the wall aperture centerline.

The second section may extend between ninety degrees and two-hundred and seventy degrees about the wall aperture centerline.

The combustor wall may also include a heat shield and a shell. The heat shield may include the panel, the boss and the cooling apertures. The heat shield may be attached to the shell. The boss may project out from the second panel surface to a distal end of the boss. The distal end may engage the shell.

The apparatus may also include an igniter received by the wall aperture.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
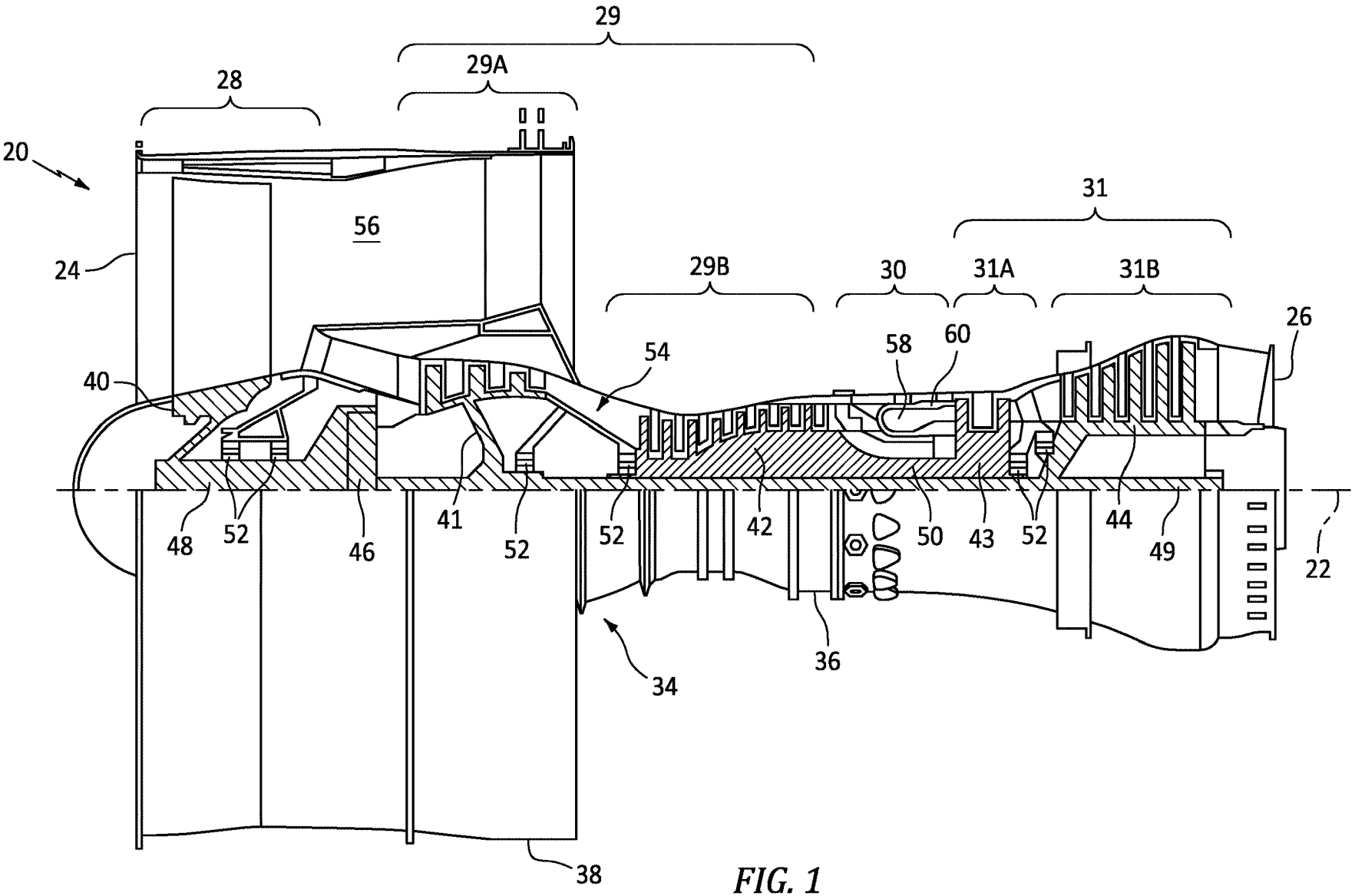
FIG. 1 is a side cutaway illustration of a geared gas turbine engine.

FIG. 1 is a side cutaway illustration of a geared gas turbine engine 20. This turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28-31B are arranged sequentially along the axial centerline 22 within an engine housing 34. This engine housing 34 includes an inner case 36 (e.g., a core case) and an outer case 38 (e.g., a fan case). The inner case 36 may house one or more of the engine sections 29A-31B; e.g., a core of the turbine engine 20. The outer case 38 may house at least the fan section 28.

Each of the engine sections 28, 29A, 29B, 31A and 31B includes a respective bladed rotor 40-44. Each of these bladed rotors 40-44 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 40 is connected to a geartrain 46, for example, through a fan shaft 48. The geartrain 46 and the LPC rotor 41 are connected to and driven by the LPT rotor 44 through a low speed shaft 49. The HPC rotor 42 is connected to and driven by the HPT rotor 43 through a high speed shaft 50. The shafts 48-50 are rotatably supported by a plurality of bearings 52; e.g., rolling element and/or thrust bearings. Each of these bearings 52 is connected to the engine housing 34 by at least one stationary structure such as, for example, an annular support strut.

During operation, air enters the turbine engine 20 through the airflow inlet 24. This air is directed through the fan section 28 and into a core flowpath 54 and a bypass flowpath 56. The core flowpath 54 extends sequentially through the engine sections 29A-31B; e.g., the engine core. The air within the core flowpath 54 may be referred to as "core air". The bypass flowpath 56 extends through a bypass duct, which bypasses the engine core. The air within the bypass flowpath 56 may be referred to as "bypass air".

The core air is compressed by the LPC rotor 41 and the HPC rotor 42 and directed into a combustion chamber 58 of a combustor 60 in the combustor section 30. Fuel is injected into the combustion chamber 58 and mixed with the compressed core air to provide a fuel-air mixture. This fuel-air mixture is ignited and combustion products thereof flow through and sequentially cause the HPT rotor 43 and the LPT rotor 44 to rotate. The rotation of the HPT rotor 43 and the LPT rotor 44 respectively drive rotation of the HPC rotor 42 and the LPC rotor 41 and, thus, compression of the air received from a core airflow inlet. The rotation of the LPT rotor 44 also drives rotation of the fan rotor 40, which propels bypass air through and out of the bypass flowpath 56. The propulsion of the bypass air may account for a majority of thrust generated by the turbine engine 20.

Figure 2:
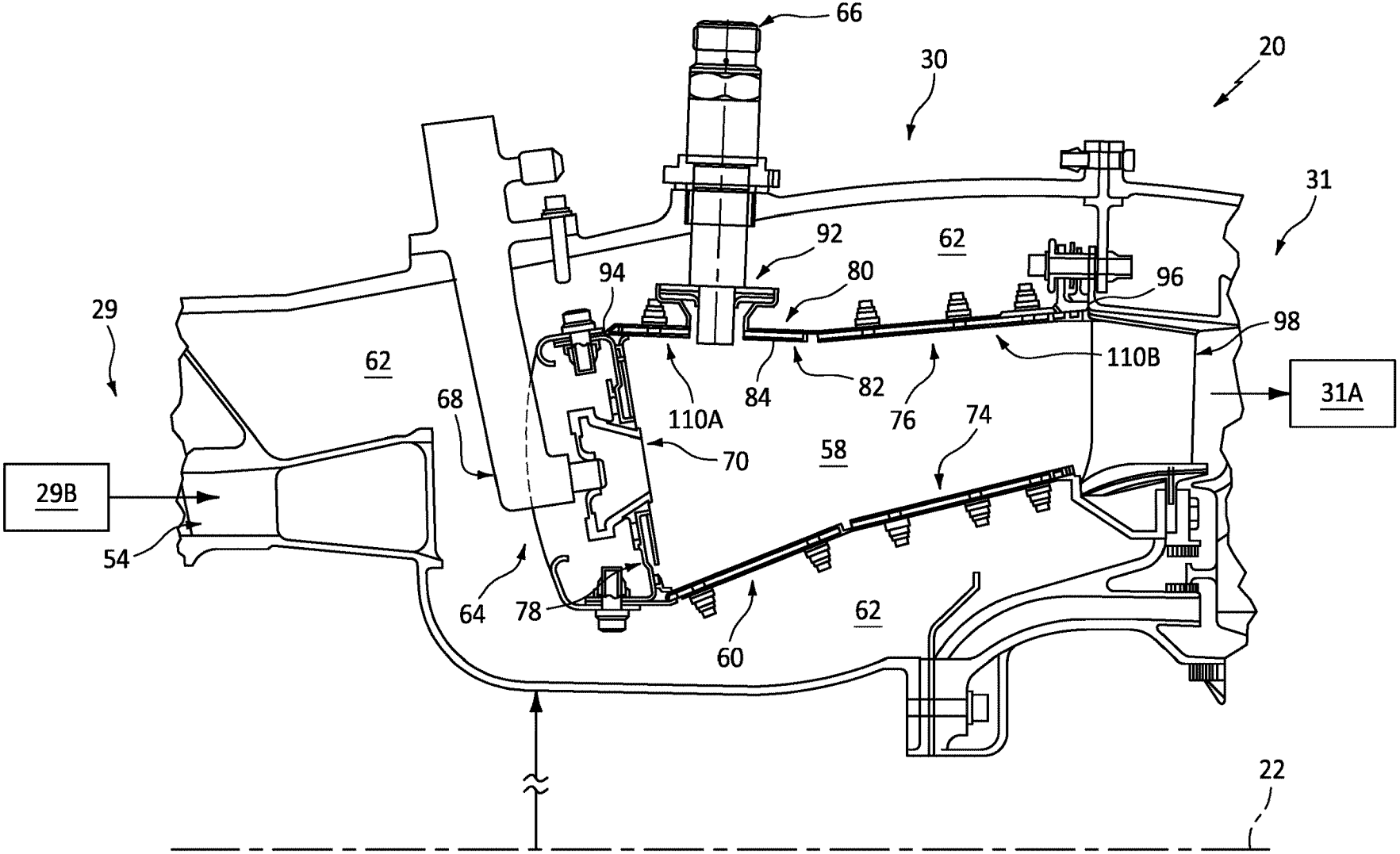
FIG. 2 is a side sectional illustration of a portion of a combustor section between a compressor section and a turbine section.
Figure 3:
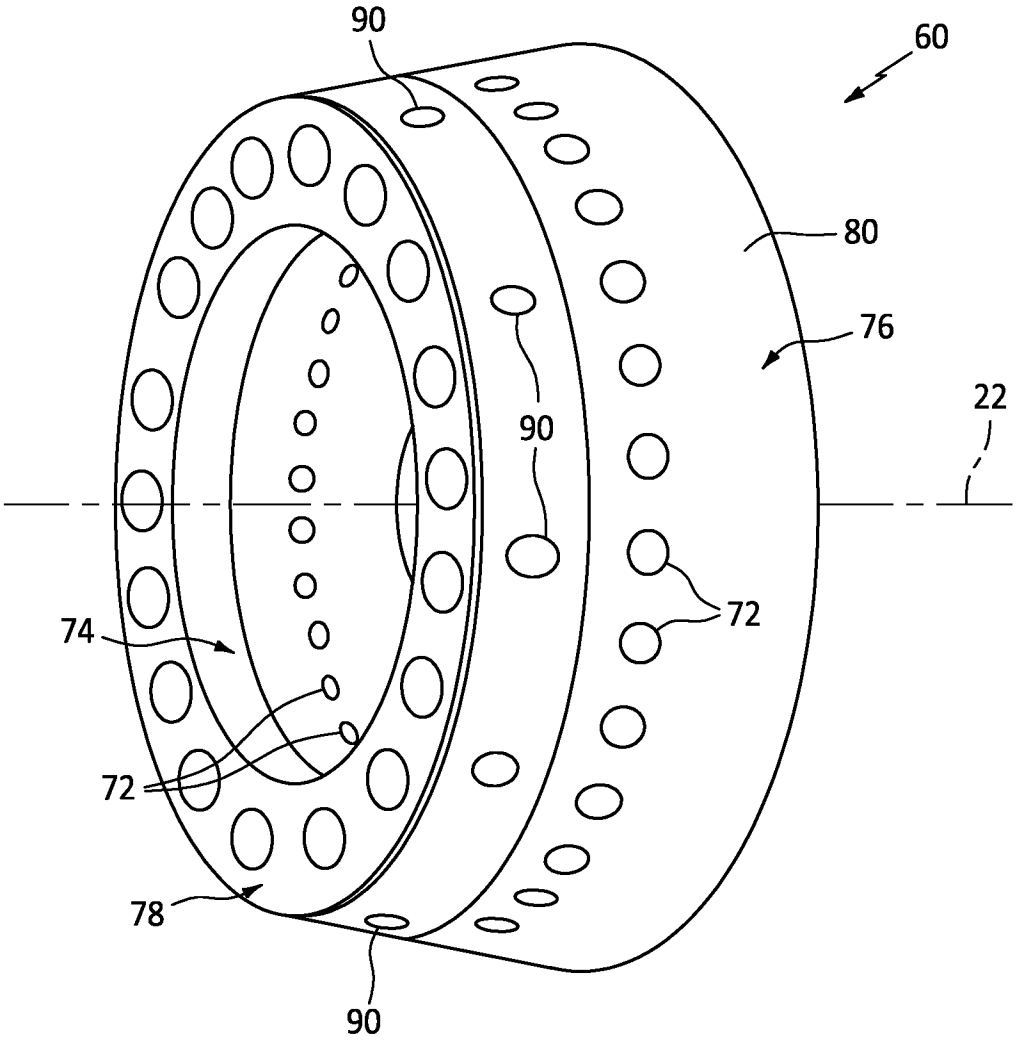
FIG. 3 is a perspective illustration of a combustor.

FIG. 2 illustrates a portion of the combustor section 30 along the core flowpath 54 between the HPC section 29B and the HPT section 31A. This combustor section 30 includes the combustor 60, a diffuser plenum 62, one or more fuel injectors 64 (one visible in FIG. 2) and one or more igniters 66 (one visible in FIG. 2). Briefly, the combustor 60 is disposed with (e.g., surrounded by) the diffuser plenum 62. This diffuser plenum 62 receives the compressed core air from the HPC section 29B, and provides the received core air to the combustor 60 as described below in further detail. Each fuel injector 64 may include a fuel nozzle 68 mated with an air swirler 70. The fuel nozzle 68 injects the fuel into the combustion chamber 58. The air swirler 70 directs some of the core air from the diffuser plenum 62 into the combustion chamber 58 in a manner that facilitates mixing the core air with the injected fuel. The igniters 66 ignite the fuel-air mixture within the combustion chamber 58. One or more quench apertures 72 (see FIG. 3) in each wall 74, 76 of the combustor 60 direct additional core air from the diffuser plenum 62 into the combustion chamber 58 to quench (e.g., stoichiometrically lean) the combustion products; e.g., the ignited fuel-air mixture.

The combustor 60 may be configured as an annular combustor; e.g., an annular floating wall combustor. The combustor 60 of FIGS. 2 and 3, for example, includes an annular combustor bulkhead 78, the tubular inner combustor wall 74 ("inner wall"), and the tubular outer combustor wall 76 ("outer wall"). The bulkhead 78 of FIG. 2 extends radially between and to the inner wall 74 and the outer wall 76. The bulkhead 78 may be connected (e.g., mechanically fastened or otherwise attached) to the inner wall 74 and/or the outer wall 76. Each combustor wall projects axially along the axial centerline 22 out from the bulkhead 78 towards the HPT section 31A. With this arrangement, the combustion chamber 58 is formed by and extends radially within the combustor 60 between the inner wall 74 and the outer wall 76. The combustion chamber 58 is formed by and extends axially (in an upstream direction along the core flowpath 54) into the combustor 60 to the bulkhead 78. The combustion chamber 58 also extends within the combustor 60 circumferentially about (e.g., completely around) the axial centerline 22, which may configure the combustion chamber 58 as a full-hoop annulus.

Figure 4:
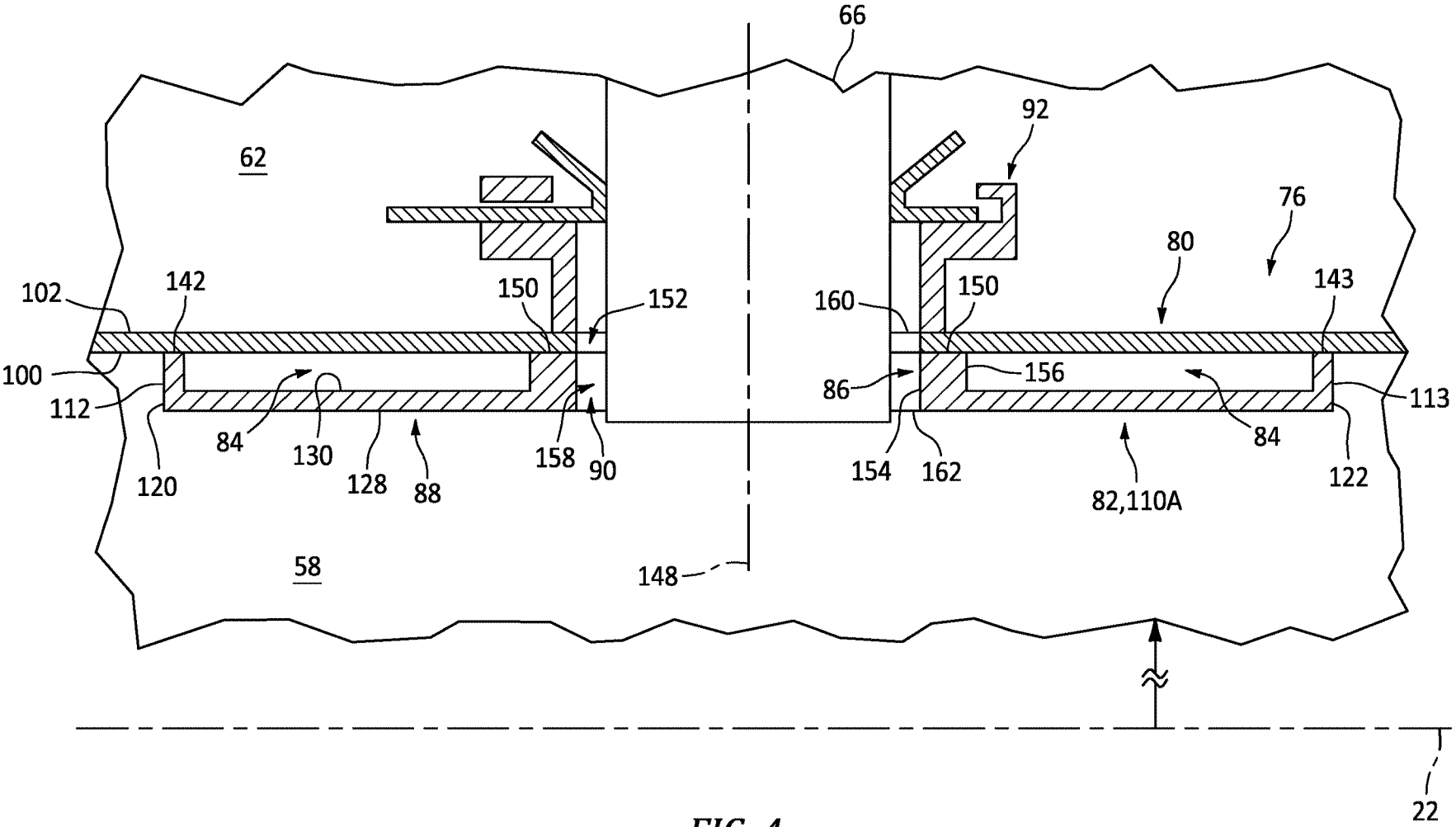
FIG. 4 is a side sectional illustration of a portion of a combustor wall at an interface with an igniter.

Referring to FIG. 4, the outer wall 76 may be configured as a multi-walled structure; e.g., a hollow, dual-walled structure. The outer wall 76 of FIG. 4, for example, includes a tubular combustor shell 80, a tubular combustor heat shield 82 and one or more cooling cavities 84 (e.g., impingement cavities) formed by and radially between the shell 80 and the heat shield 82. However, it is contemplated the outer wall 76 may alternatively be configured as a single-walled structure where, for example, the shell 80 is omitted and the heat shield 82 forms a single walled liner/outer combustor wall. However, for ease of description, the outer wall 76 may be described below as the hollow, dual-walled structure.

The outer wall 76 includes one or more igniter aperture bodies. Each aperture body of FIG. 4 is configured as an annular heat shield boss 86 connected to and projecting out from a respective heat shield panel 88. The bosses 86 are arranged circumferentially around the axial centerline 22 in a circular array. Each boss 86 partially or completely forms a respective wall aperture 90 (e.g., an igniter aperture) in/radially through the outer wall 76, which wall aperture 90 receives a respective one of the igniters 66. Each igniter 66, for example, projects radially into or through the respective wall aperture 90. Each igniter 66 is mated to the outer wall 76 and its shell 80 by an igniter mount 92.

Referring to FIG. 2, the shell 80 extends circumferentially about (e.g., completely around) the axial centerline 22. The shell 80 extends axially along the axial centerline 22 between and to an axial upstream end 94 of the shell 80 and an axial downstream end 96 of the shell 80. The shell 80 is connected to the bulkhead 78 at the shell upstream end 94. The shell 80 may be connected to a stator vane assembly 98 (or a structure of the HPT section 31A) at the shell downstream end 96.

Figure 5:
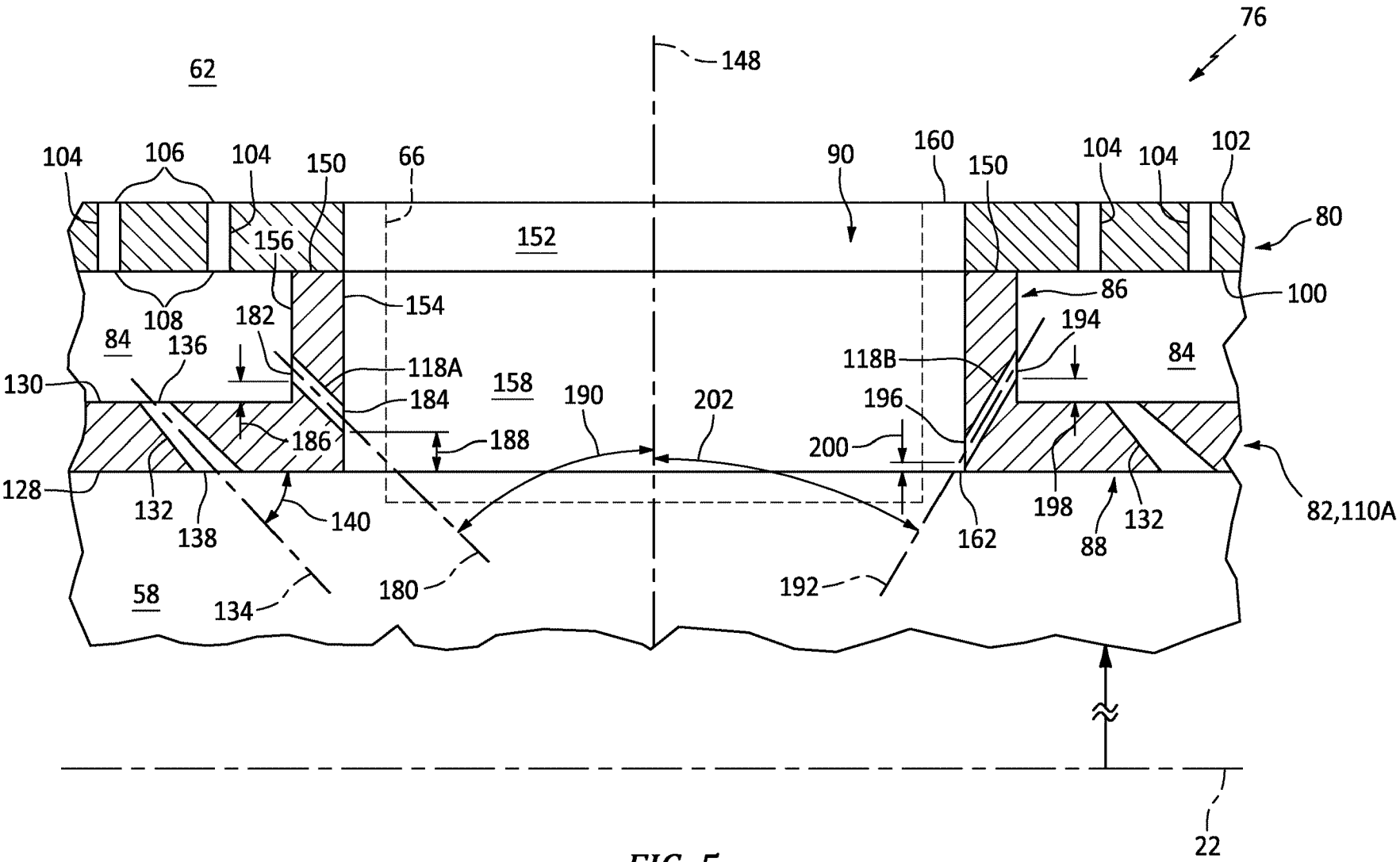
FIG. 5 is a detailed side sectional illustration of a portion of the combustor wall.

Referring to FIG. 5, the shell 80 extends radially between and to a radial inner surface 100 of the shell 80 and a radial outer surface 102 of the shell 80. The shell outer surface 102 is adjacent and forms a radial peripheral boundary of the diffuser plenum 62. The shell inner surface 100 is adjacent and forms a radial outer peripheral boundary of each cooling cavity 84.

The shell 80 may include one or more shell cooling apertures 104. Each of these shell cooling apertures 104 may be configured as an impingement aperture. Each shell cooling aperture 104 of FIG. 5, for example, extends (e.g., radially) through the shell 80 from an inlet orifice 106 into the respective shell cooling aperture 104 to an outlet orifice 108 from the respective shell cooling aperture 104. The inlet orifice 106 is disposed in the shell outer surface 102. The outlet orifice 108 is disposed in the shell inner surface 100. The shell cooling apertures 104 thereby fluidly couple the diffuser plenum 62 to each respective cooling cavity 84 within the outer wall 76. Each shell cooling aperture 104 is also configured to direct a jet of core air into the respective cooling cavity 84 to impinge against the panel 88.

Referring to FIG. 2, the heat shield 82 extends circumferentially about (e.g., completely around) the axial centerline 22. The heat shield 82 extends axially along the axial centerline 22 between and to an axial upstream end of the heat shield 82 and an axial downstream end of the heat shield 82. The heat shield upstream end is located at an interface between the outer wall 76 and the bulkhead 78. The heat shield downstream end may be located at an interface between the outer wall 76 and the stator vane assembly 98 (or the structure of the HPT section 31A).

The heat shield 82 may include one or more heat shield tiles 110A and 110B (generally referred to as "110"), one or more of which tiles 110 may have an arcuate geometry. The tiles 110 are respectively arranged at discrete locations along the axial centerline 22. The upstream tiles 110A are arranged circumferentially about the axial centerline 22 and may form an upstream heat shield section/hoop. The downstream tiles 110B are arranged circumferentially about the axial centerline 22 and may form a downstream heat shield section/hoop. The heat shield 82, however, may alternatively be configured from one or more tubular bodies.

Figure 6:
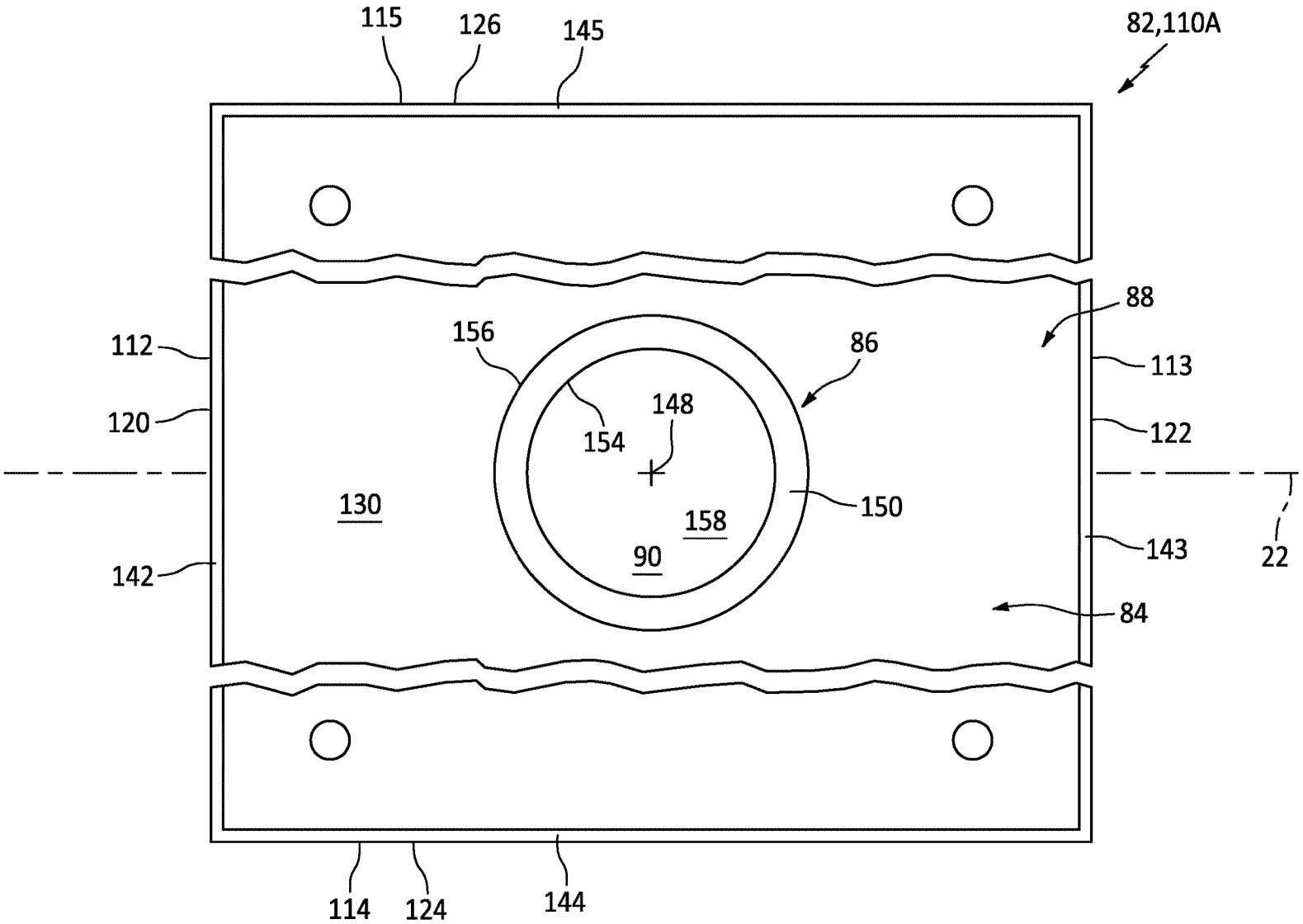
FIG. 6 is a partial plan view illustration of a heat shield tile.

Each tile 110 of FIGS. 4 and 6 includes a respective one of the panels 88, one or more rails 112-115 and at least (or only) one of the bosses 86. Each tile 110 of FIGS. 5 and 7 also includes one or more boss cooling apertures 118A and 118B (generally referred to as "118").

Referring to FIGS. 4 and 6, the panel 88 may be configured as a generally curved (e.g., arcuate) plate. The panel 88 of FIGS. 4 and 6 extends axially along the axial centerline 22 between and to an upstream end 120 of the respective tile 110 and its panel 88 and a downstream end 122 of the respective tile 110 and its panel 88. The panel 88 of FIG. 6 extends circumferentially about the axial centerline 22 between and to opposing circumferential sides 124 and 126 of the respective tile 110 and its panel 88. The panel 88 of FIG. 4 extends radially between and to a radial inner surface 128 of the respective tile 110 and its panel 88 and a radial outer surface 130 of the panel 88. The panel inner surface 128 is adjacent and forms a radial outer peripheral boundary of the combustion chamber 58. The panel outer surface 130 is adjacent and forms a radial inner peripheral boundary of the respective cooling cavity 84.

Referring to FIG. 5, the panel 88 may include one or more panel cooling apertures 132. Each of these panel cooling apertures 132 may be configured as an effusion aperture. Each panel cooling aperture 132 of FIG. 5, for example, extends (e.g., generally radially) through the panel 88 along a centerline 134 of the respective panel cooling aperture 132 from an inlet orifice 136 into the respective panel cooling aperture 132 to an outlet orifice 138 from the respective panel cooling aperture 132. The inlet orifice 136 is disposed in the panel outer surface 130. The outlet orifice 138 is disposed in the panel inner surface 128. The panel cooling apertures 132 thereby fluidly coupled each respective cooling cavity 84 within the combustion chamber 58. Each panel cooling aperture 132 is also configured to direct the core air into the respective combustion chamber 58 to form a film against the panel 88 and its panel inner surface 128. To promote formation of the film, the panel cooling aperture centerline 134 may be angularly offset from the panel inner surface 128 (and/or the panel outer surface 130) by a non-zero acute angle 140.

Referring to FIGS. 4 and 6, the rails may include one or more axial end rails 112 and 113 and/or one or more circumferential side rails 114 and 115. Each of the tile rails 112-115 is connected to (e.g., formed integral with or otherwise bonded to) the panel 88. Each of these tile rails 112-115 projects radially out from the panel 88 and its panel outer surface 130 to a radial outer distal end 142-145 of the respective tile rail 112-115. Each of these rail distal ends 142-145 may be configured to radially engage (e.g., contact, abut against, etc.) the shell 80 and its shell inner surface 100.

Referring to FIG. 6, each of the axial end rails 112, 113 is disposed at a respective one of the panel ends 120, 122. Each of the axial end rails 112, 113 extends circumferentially along the respective panel end 120, 122 between and to the circumferential side rails 114 and 115. Each of the circumferential side rails 114, 115 is disposed at a respective one of the panel sides 124, 126. Each of the circumferential side rails 114, 115 extends axially along the respective panel side 124, 126 between and to the axial end rails 112 and 113. With this arrangement, each cooling cavity 84 extends within the outer wall 76 axially between the respective axial end rails 112 and 113. Each cooling cavity 84 extends within the outer wall 76 circumferentially between the respective side rails 114 and 115. Referring to FIG. 4, each cooling cavity 84 extends within the outer wall 76 radially between the respective panel outer surface 130 and the shell inner surface 100.

Referring to FIG. 6, the boss 86 may be arranged intermediately (e.g., centered or otherwise position) within a respective one of the cooling cavities 84. The boss 86 of FIG. 6, for example, is axially between and axially spaced from the respective axial end rails 112 and 113. The boss 86 of FIG. 6 is further circumferentially between and circumferentially spaced from the respective circumferential side rails 114 and 115.

The boss 86 of FIG. 4 is connected to (e.g., formed integral with or otherwise bonded to) the panel 88. This boss 86 projects radially (e.g., longitudinally along a longitudinal centerline 148 of a respective wall aperture 90) out from the panel 88 and its panel outer surface 130, radially through the respective cooling cavity 84, to a radial outer distal end 150 of the boss 86. This boss distal end 150 may be configured to radially engage (e.g., contact, abut against, etc.) the shell 80 and its shell inner surface 100. Here, the boss 86 is (e.g., circumferentially and axially) aligned with and extends circumferentially about a port 152 through the shell 80, which port 152 forms an outer/upstream portion of the respective wall aperture 90. However, the boss 86 may alternatively project radially into or through the port 152 in other embodiments.

The boss 86 of FIG. 4 extends laterally (e.g., radially relative to the wall aperture centerline 148) between and to an inner surface 154 of the respective wall aperture 90 and an outer surface 156 of the boss 86. The aperture inner surface 154 of FIG. 4 is formed by the boss 86 and the panel 88. This aperture inner surface 154 may form a bore 158 through the heat shield 82, which bore 158 forms an inner/downstream portion of the wall aperture 90 through the outer wall 76. With this arrangement, the wall aperture 90 may extend radially (e.g., longitudinally along the wall aperture centerline 148) through the outer wall 76 from an inlet orifice 160 into the wall aperture 90 to an outlet orifice 162 from the wall aperture 90. The inlet orifice 160 of FIG. 4 is formed by the port 152 and is disposed in the shell outer surface 102. The outlet orifice 162 of FIG. 4 is formed by the bore 158 and is disposed in the panel inner surface 128.

Figure 7:
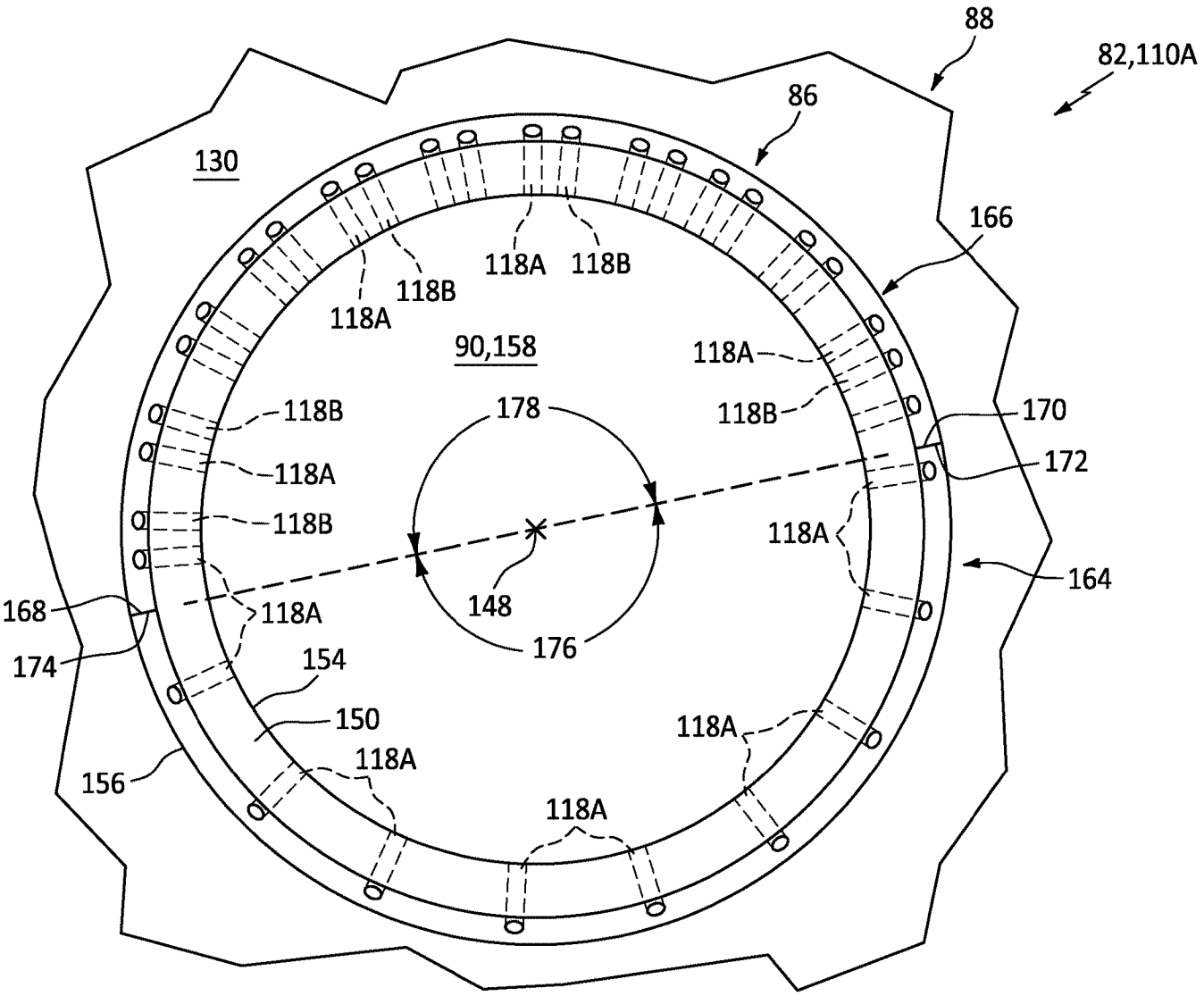
FIG. 7 is a partial plan view illustration of the heat shield tile at a boss.

Referring to FIG. 7, the boss cooling apertures 118 are arranged circumferentially about the respective wall aperture 90 and its wall aperture centerline 148 in a multi-section array. The first boss cooling apertures 118A, for example, may be arranged circumferentially around the respective wall aperture 90 and its wall aperture centerline 148 in a circular array. The second boss cooling apertures 118B may be arranged circumferentially about the respective wall aperture 90 and its wall aperture centerline 148 in an arcuate array. With this arrangement, a circumferential first section 164 of the boss 86 (e.g., only) includes a set of one or more of the first boss cooling apertures 118A. A circumferential second section 166 of the boss 86 (e.g., only) includes a set of one or more of the first boss cooling apertures 118A and one or more of the second boss cooling apertures 118B. Within this second section 166, the first boss cooling apertures 118A may be circumferentially interspersed with the second boss cooling apertures 118B. For example, one (or each) first boss cooling aperture 118A may be arranged circumferentially between a neighboring (e.g., adjacent) pair of the second boss cooling apertures 118B. Similarly, one (or each) second boss cooling aperture 118B may be arranged circumferentially between a neighboring pair of the first boss cooling apertures 118A. However, in other embodiments, it is contemplated two or more of the second boss cooling apertures 118B may be disposed circumferentially between a neighboring pair of the first boss cooling apertures 118A. It is also or alternatively contemplated two or more of the first boss cooling apertures 118A may be disposed circumferentially between a neighboring pair of the second boss cooling apertures 118B.

The first section 164 extends circumferentially about the respective wall aperture 90 and its wall aperture centerline 148 a first section length between and to opposing circumferential ends 168 and 170 of the first section 164. The second section 166 extends circumferentially about the respective wall aperture 90 and its wall aperture centerline 148 a second section length between and to the opposing circumferential ends 172 and 174 of the second section 166. The second section first end 172 of FIG. 7 is disposed at the first section second end 170. The second section second end 174 of FIG. 7 is disposed at the first section first end 168. The first section length may be characterized by a first number of degrees 176 about the wall aperture centerline 148, and the second section length may be characterized by a second number of degrees 178 about the wall aperture centerline 148. The first number of degrees 176 may be equal to or different (e.g., greater or less) than the second number of degrees 178. The first number of degrees 176 and the second number of degrees 178 may each be between ninety degrees (90°) and two-hundred and seventy degrees (270°); e.g., between one-hundred and sixty degrees (160°) and two-hundred degrees (200°). The present disclosure, however, is not limited to the foregoing exemplary relationship between the first section 164 and the second section 166. Furthermore, it is contemplated the boss 86 may include one or more additional sections with their own arrangements of boss cooling apertures, or the first section 164 or the second section 166 may be omitted.

Figure 8:
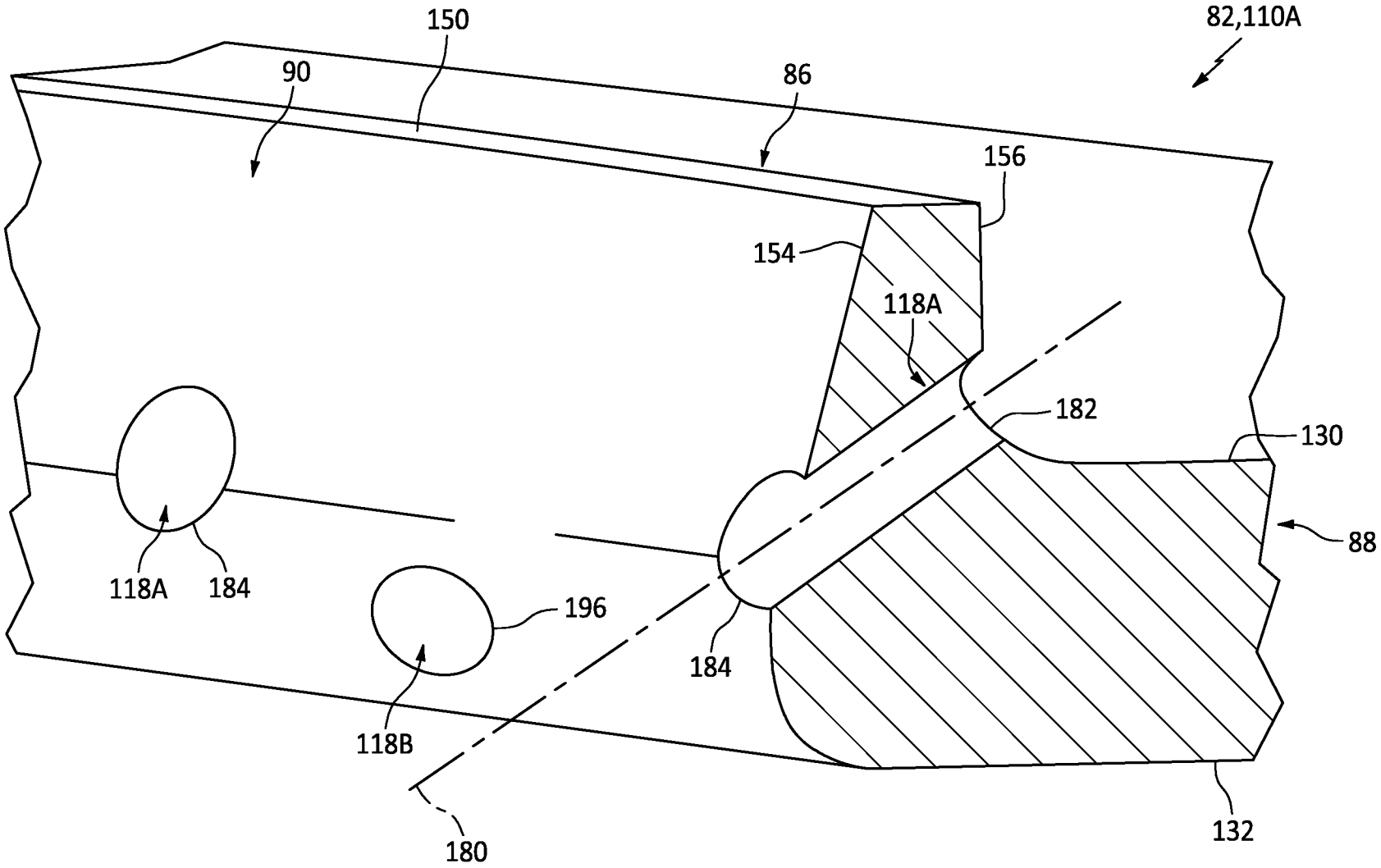
FIG. 8 is a perspective cutaway illustration of a portion of the heat shield tile at a first cooling aperture in the boss.

Referring to FIG. 5, each first boss cooling aperture 118A may be formed by and/or extend through the boss 86 and/or the panel 88; see also FIG. 8. Each first boss cooling aperture 118A of FIG. 5, for example, extends (e.g., laterally and longitudinally relative to the wall aperture centerline 148) through the respective tile 110 along a (e.g., straight) centerline 180 of the respective first boss cooling aperture 118A from an inlet orifice 182 into the respective first boss cooling aperture 118A to an outlet orifice 184 from the respective first boss cooling aperture 118A. The first inlet orifice 182 may be disposed in the boss outer surface 156. This first inlet orifice 182 is disposed a first inlet radial distance 186 (relative to the axial centerline 22) from the panel outer surface 130. The first outlet orifice 184 may be disposed in the aperture inner surface 154 along the boss 86 and/or the panel 88. The first outlet orifice 184 is disposed a first outlet radial distance 188 (relative to the axial centerline 22) from the panel inner surface 128. The first outlet orifice 184 may be circumferentially aligned with the first inlet orifice 182 of the same first boss cooling aperture 118A about the wall aperture centerline 148. However, it is contemplated the first outlet orifice 184 may alternatively be circumferentially offset from the first inlet orifice 182 of the same first boss cooling aperture 118A about the wall aperture centerline 148.

The first boss cooling aperture centerline 180 is angularly offset from the wall aperture centerline 148 by a first angle 190; e.g., a non-zero acute angle. This first angle 190 may be between ten degrees (10°) and sixty degrees (60°); e.g., between twenty degrees (20°) and forty-five degrees (45°). The present disclosure, however, is not limited to the foregoing exemplary angles. With this arrangement, each first boss cooling aperture 118A is configured to cool a portion of the boss 86 and/or the panel 88 as well as the respective igniter 66. Each first boss cooling aperture 118A is also configured to purge gas out of the wall aperture 90. This may reduce stagnation within the wall aperture 90 as well as backflow of combustion products into the wall aperture 90 from the combustion chamber 58.

Figure 9:
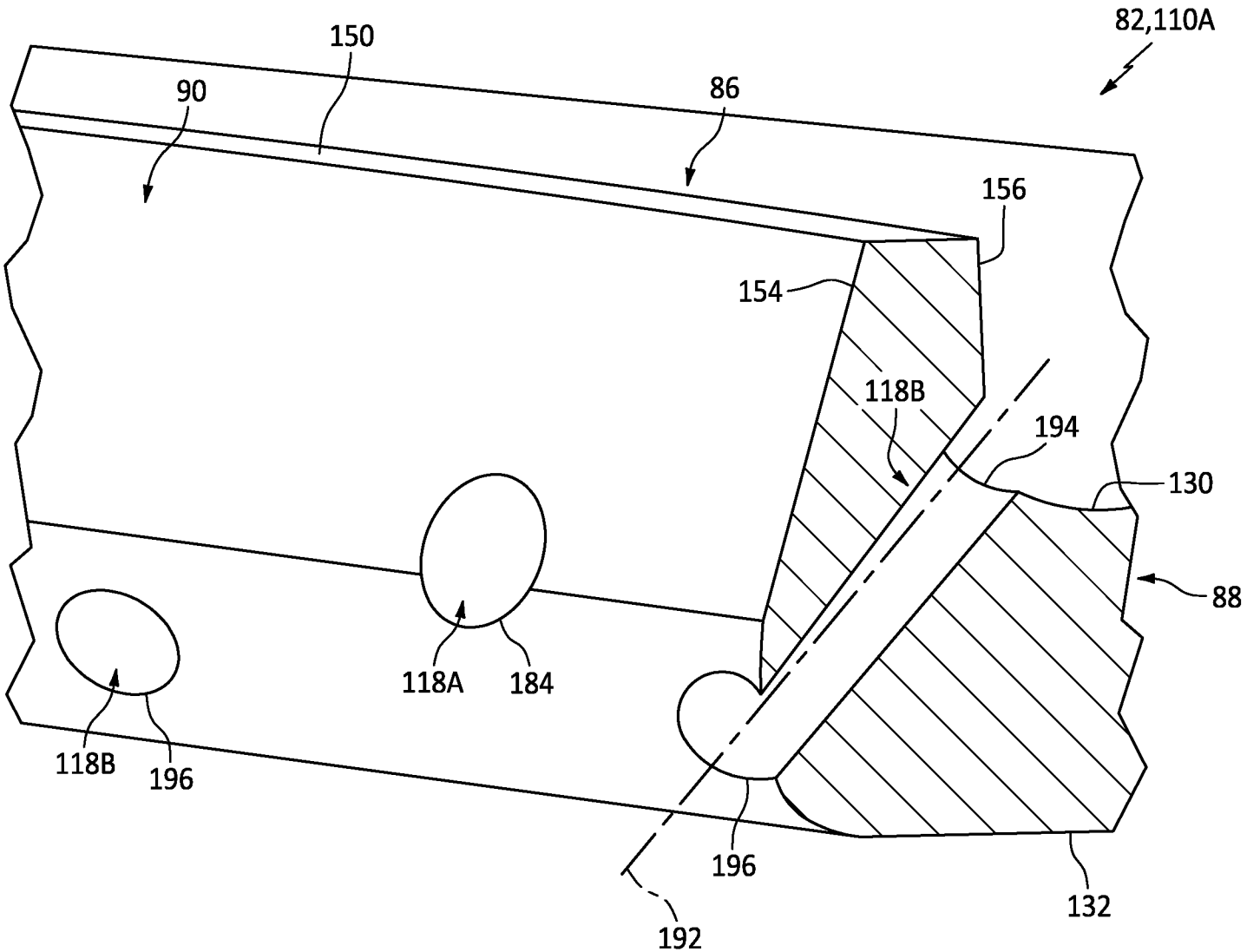
FIG. 9 is a perspective cutaway illustration of a portion of the heat shield tile at a second cooling aperture in the boss.

Referring to FIG. 5, each second boss cooling aperture 118B may be formed by and/or extend through the boss 86 and/or the panel 88; see also FIG. 9. Each second boss cooling aperture 118B of FIG. 5, for example, extends (e.g., laterally and longitudinally relative to the wall aperture centerline 148) through the respective tile 110 along a (e.g., straight) centerline 192 of the respective second boss cooling aperture 118B from an inlet orifice 194 into the respective second boss cooling aperture 118B to an outlet orifice 196 from the respective second boss cooling aperture 118B. The second inlet orifice 194 may be disposed in the boss outer surface 156. This second inlet orifice 194 is disposed a second inlet radial distance 198 (relative to the axial centerline 22) from the panel outer surface 130. The second outlet orifice 196 may be disposed in the aperture inner surface 154 along the boss 86 and/or the panel 88. The second outlet orifice 196 is disposed a second outlet radial distance 200 (relative to the axial centerline 22) from the panel inner surface 128. The second outlet orifice 196 may be circumferentially aligned with the second inlet orifice 194 of the same second boss cooling aperture 118B about the wall aperture centerline 148. However, it is contemplated the second outlet orifice 196 may alternatively be circumferentially offset from the second inlet orifice 194 of the same second boss cooling aperture 118B about the wall aperture centerline 148.

The second inlet radial distance 198 of FIG. 5 may be sized the same as the first inlet radial distance 186. With such an arrangement, each second inlet orifice 194 may be longitudinally aligned with each first inlet orifice 182 along the wall aperture centerline 148. Furthermore, the second outlet radial distance 200 may be sized different (e.g., smaller) than the first outlet radial distance 188. With such an arrangement, each second outlet orifice 196 may be longitudinally offset from (e.g., misaligned with) each first outlet orifice 184 along the wall aperture centerline 148. By offsetting the outlet orifices 184 and 196, additional material of the tile 110 may be utilized for forming the boss cooling apertures 118 (see FIG. 7). A density of the boss cooling apertures 118 may thereby be increased to facilitate additional cooling in the second section 166 (see FIG. 7).

The second boss cooling aperture centerline 192 is angularly offset from the wall aperture centerline 148 by a second angle 202; e.g., a non-zero acute angle. This second angle 202 may be between thirty degrees (30°) and eighty degrees (80°); e.g., between forty-five degrees (45°) and seventy degrees (70°). The present disclosure, however, is not limited to the foregoing exemplary angles. With this arrangement, each second boss cooling aperture 118B is configured to cool a portion of the boss 86 and/or the panel 88 as well as the respective igniter 66. Each second boss cooling aperture 118B is also configured to purge gas out of the wall aperture 90. This may reduce stagnation within the wall aperture 90 as well as backflow of combustion products into the wall aperture 90 from the combustion chamber 58.

In addition to providing cooling for the tile 110/the heat shield 82 and the igniter 66, the boss cooling apertures 118 may reduce pressure drop across the outer wall 76. Providing the discrete boss cooling apertures 118, for example, may provide effective cooling while eliminating slots and/or other large openings through a sidewall of each boss 86 as may be employed in other designs. Reducing pressure drop may facilitate increasing cooling air to other locations within the turbine engine 20 and/or an increase in turbine engine efficiency.

While the bosses 86 are described above with respect to forming the apertures 90 for the igniters 66, it is contemplated the bosses 86 may also or alternatively be utilized to form one or more of the quench apertures 72 through the outer wall 76, or the inner wall 74. The present disclosure therefore is not limited to igniter aperture applications.

The combustor wall and its boss cooling scheme may be included in various turbine engines other than the one described above. The combustor wall and its boss cooling scheme, for example, may be included in a geared turbine engine where a geartrain connects one or more shafts to one or more rotors in a fan section, a compressor section and/or any other engine section. Alternatively, the combustor wall and its boss cooling scheme may be included in a turbine engine configured without a geartrain; e.g., a direct drive turbine engine. The combustor wall and its boss cooling scheme may be included in a geared or non-geared turbine engine configured with a single spool, with two spools (e.g., see FIG. 1), or with more than two spools. The turbine engine may be configured as a turbofan engine, a turbojet engine, a turboprop engine, a turboshaft engine, a propfan engine, a pusher fan engine or any other type of turbine engine. The turbine engine may alternatively be configured as an auxiliary power unit (APU) or an industrial gas turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An apparatus for a turbine engine, comprising:

a combustor wall including a panel, a boss, a wall aperture and a plurality of cooling apertures;

the panel extending axially along and circumferentially about an axial centerline, the panel extending radially between a first panel surface and a second panel surface, and the first panel surface forming a peripheral boundary of a combustion chamber;

the boss projecting out from the second panel surface, and the boss extending circumferentially around and forming an outer peripheral boundary of the wall aperture;

the wall aperture extending along a wall aperture centerline through the combustor wall to the first panel surface; and the plurality of cooling apertures arranged circumferentially about the wall aperture, each of the plurality of cooling apertures extending along a cooling aperture centerline through at least one of the panel or the boss to the wall aperture, the cooling aperture centerline of a first of the plurality of cooling apertures angularly offset from the wall aperture centerline by a first acute angle, and the cooling aperture centerline of a second of the plurality of cooling apertures angularly offset from the wall aperture centerline by a second acute angle that is different than the first acute angle.

2. The apparatus of claim 1, wherein the first acute angle is between twenty degrees and forty-five degrees.

3. The apparatus of claim 1, wherein the first acute angle is between forty-five degrees and seventy degrees.

4. The apparatus of claim 1, wherein the cooling aperture centerline of the first of the plurality of cooling apertures is straight.

5. The apparatus of claim 1, wherein the second of the plurality of cooling apertures circumferentially neighbors the first of the plurality of cooling apertures about the wall aperture.

6. The apparatus of claim 1, wherein a first inlet orifice into the first of the plurality of cooling apertures is disposed a first radial distance from the second panel surface; and a second inlet orifice into the second of the plurality of cooling apertures is disposed a second radial distance from the second panel surface that is equal to the first radial distance.

7. The apparatus of claim 1, wherein a first outlet orifice from the first of the plurality of cooling apertures is disposed a first radial distance from the first panel surface; and a second outlet orifice from the second of the plurality of cooling apertures is disposed a second radial distance from the first panel surface that is different than the first radial distance.

8. The apparatus of claim 1, wherein a first inlet orifice into the first of the plurality of cooling apertures and a second inlet orifice into the second of the plurality of cooling apertures are longitudinally aligned along the wall aperture centerline.

9. The apparatus of claim 1, wherein a first outlet orifice from the first of the plurality of cooling apertures and a second outlet orifice from the second of the plurality of cooling apertures are longitudinally offset along the wall aperture centerline.

10. The apparatus of claim 1, wherein a first section of the boss includes a first set of the plurality of cooling apertures, and the cooling aperture centerline of each cooling aperture in the first set of the plurality of cooling apertures is angularly offset from the wall aperture centerline by the first acute angle; and a second section of the boss, circumferentially adjacent the first section, includes a second set of the plurality of cooling apertures, the cooling aperture centerline of one cooling aperture in the second set of the plurality of cooling apertures is angularly offset from the wall aperture centerline by the first acute angle, and the cooling aperture centerline of another cooling aperture in the second set of the plurality of cooling apertures is angularly offset from the wall aperture centerline by the second acute angle.

11. The apparatus of claim 10, wherein the first section extends circumferentially about the wall aperture centerline from a first end of the first section to a second end of the first section; and the second section extends circumferentially about the wall aperture centerline from the first end of the first section to the second end of the first section.

12. The apparatus of claim 10, wherein the first section extends between ninety degrees and two-hundred and seventy degrees about the wall aperture centerline.

13. The apparatus of claim 10, wherein the second section extends between ninety degrees and two-hundred and seventy degrees about the wall aperture centerline.

14. The apparatus of claim 1, wherein the combustor wall further includes a heat shield and a shell;

the heat shield includes the panel, the boss and the plurality of cooling apertures, and the heat shield is attached to the shell; and the boss projects out from the second panel surface to a distal end of the boss, and the distal end engages the shell.

15. The apparatus of claim 1, further comprising an igniter received by the wall aperture.

16. A combustor for a turbine engine, comprising:

a combustor wall including a heat shield, a shell, a cooling cavity and a wall aperture extending along a wall aperture centerline through the combustor wall;

the heat shield attached to the shell, and the heat shield including a panel, a boss and a plurality of cooling apertures;

the boss projecting out from the panel, through the cooling cavity, to a distal end of the boss engaged with the shell, and the boss extending circumferentially around and forming an outer peripheral boundary of the wall aperture; and the plurality of cooling apertures arranged circumferentially about the wall aperture, each of the plurality of cooling apertures extending along a cooling aperture centerline through at least one of the panel or the boss to the wall aperture, the cooling aperture centerline of a first of the plurality of cooling apertures angularly offset from the wall aperture centerline by a first acute angle, and the cooling aperture centerline of a second of the plurality of cooling apertures angularly offset from the wall aperture centerline by a second acute angle that is different than the first acute angle.

17. An apparatus for a turbine engine, comprising:

a combustor wall including a panel, a boss, a wall aperture and a plurality of cooling apertures;

the panel extending axially along and circumferentially about an axial centerline, the panel extending radially between a first panel surface and a second panel surface, and the first panel surface forming a peripheral boundary of a combustion chamber;

the boss projecting out from the second panel surface, and the boss extending circumferentially around and forming an outer peripheral boundary of the wall aperture;

the wall aperture extending along a wall aperture centerline through the combustor wall to the first panel surface, and the wall aperture including an inner surface formed by the boss and the panel;

the plurality of cooling apertures arranged circumferentially about the wall aperture, each of the plurality of cooling apertures extending along a cooling aperture centerline through at least one of the panel or the boss to the wall aperture, the cooling aperture centerline of a first of the plurality of cooling apertures angularly offset from the wall aperture centerline by a first acute angle, and the cooling aperture centerline of a second of the plurality of cooling apertures angularly offset from the wall aperture centerline by a second acute angle that is different than the first acute angle;

a first outlet orifice from the first of the plurality of cooling apertures disposed a first radial distance from the first panel surface, and the first outlet orifice disposed on the inner surface of the wall aperture; and a second outlet orifice from the second of the plurality of cooling apertures disposed a second radial distance from the first panel surface that is different than the first radial distance from the first panel surface, and the second outlet orifice disposed on the inner surface of the wall aperture.

18. The apparatus of claim 17, wherein the first outlet orifice and the second outlet orifice are disposed radially outboard of the first panel surface.

19. The apparatus of claim 17, wherein a first inlet orifice into the first of the plurality of cooling apertures is disposed a first radial distance from the second panel surface; and a second inlet orifice into the second of the plurality of cooling apertures is disposed a second radial distance from the second panel surface that is equal to the first radial distance from the second panel surface.

20. The apparatus of claim 17, wherein the first outlet orifice and the second outlet orifice are longitudinally offset along the wall aperture centerline.

* * * * *